US006612136B2

(12) United States Patent
Roe

(10) Patent No.: US 6,612,136 B2
(45) Date of Patent: Sep. 2, 2003

(54) DOUBLE LAYER SOCK AND METHOD FOR MAKING SAME

(75) Inventor: Steven K. Roe, Waldo, WI (US)

(73) Assignee: Wigwam Mills, Inc., Sheboygan, WI (US)

( * ) Notice: Subject to any disclaimer, the term of this patent is extended or adjusted under 35 U.S.C. 154(b) by 0 days.

(21) Appl. No.: 10/072,377

(22) Filed: Feb. 7, 2002

(65) Prior Publication Data

US 2003/0145632 A1 Aug. 7, 2003

(51) Int. Cl.[7] ..... D04B 11/00
(52) U.S. Cl. ..... 66/178 R
(58) Field of Search ..... 66/178 R, 179, 66/180, 181, 182, 183, 184, 185, 186, 187, 178 A; 2/239–240

(56) References Cited

U.S. PATENT DOCUMENTS

| | | | | |
|---|---|---|---|---|
| 1,388,781 A | | 8/1921 | Stibbe | |
| 2,214,021 A | | 9/1940 | Hill | |
| 2,433,931 A | | 1/1948 | Pierre | |
| 3,259,915 A | * | 7/1966 | Dison | 2/239 |
| 3,796,067 A | | 3/1974 | East | |
| 4,341,096 A | * | 7/1982 | Safrit et al. | 2/239 |
| 4,373,215 A | * | 2/1983 | Guigley | 2/239 |
| 4,467,626 A | * | 8/1984 | Coble et al. | 66/178 R |
| 4,571,960 A | | 2/1986 | Hursh et al. | |
| 4,615,188 A | * | 10/1986 | Hursh et al. | 2/239 |
| 4,843,844 A | * | 7/1989 | Hursh et al. | 66/196 |
| 4,941,331 A | | 7/1990 | Cournoyer et al. | |
| 4,958,507 A | | 9/1990 | Allaire et al. | |
| 5,226,194 A | * | 7/1993 | Staley | 2/239 |
| 5,675,992 A | | 10/1997 | Wrightenberry | |
| 5,778,702 A | | 7/1998 | Wrightenberry | |
| 6,158,254 A | | 12/2000 | Richard | |

FOREIGN PATENT DOCUMENTS

| | | |
|---|---|---|
| DE | 44 05 609 A1 | 8/1995 |
| FR | 2 503 198 A | 10/1982 |
| GB | 848 218 A | 9/1960 |
| JP | 09176938 A | 7/1997 |
| WO | WO 93/16222 | 8/1993 |

* cited by examiner

*Primary Examiner*—Danny Worrell
(74) *Attorney, Agent, or Firm*—Alston & Bird, LLP

(57) ABSTRACT

A sock of double layer knit construction formed on a circular knitting machine, including a tubular inner layer and a tubular outer layer surrounding the inner layer. The inner layer and the outer layer are connected together during the knitting thereof at spaced locations by a yarn extending between the layers. The connecting yarn is knit predominately in one of the layers and is knit into the other layer for connecting purposes only. The connecting yarn is knit into the other layer as tuck stitch loops.

15 Claims, 2 Drawing Sheets

DOUBLE LAYER SOCK AND METHOD FOR MAKING SAME

FIELD OF THE INVENTION

The present invention relates to a double layer sock. More particularly, the present invention relates to a sock having two layers of the same or different material connected together at spaced locations with tuck stitches and to a method for making the sock.

BACKGROUND OF THE INVENTION

Double layer socks provide additional cushioning of the foot when the wearer is engaged in activities such as running, hiking and the like. Such socks also may be made to be particularly effective at absorbing perspiration. Double layer socks provide for movement between the layers thereby reducing the movement between the inner layer and the wearer's foot, resulting in a more comfortable fit. Single, as well as double layer socks are generally knit as a sock blank with a cuff or welt surrounding an opening at the leg portion and an opening at the toe portion. The toe opening of a machine knit sock is then closed.

One means of cushioning socks is to produce a pair of socks with a terry layer such as that disclosed in U.S. Pat. No. 3,796,0675 to East in which the sock has a smooth knit outer layer and an inner layer having terry loops on both inner and outer surfaces. East teaches forming the sock by knitting a single elongated tube on one-half of which is of smooth knit fabric and one-half is a terry knit fabric. Then the terry knit portion is everted within the other half to achieve two layers, and closing the toe. Thus, the double layers of the sock of East are connected only at the leg opening and at the toe closure.

A double layer sock is also disclosed in U.S. Pat. No. 4,571,690 to Hursh et al. which describes an athletic sock having a double-ply foot portion including an inner ply with an inner surface comprising a plurality of substantially untwisted fibers around which a yarn is spirally wound and an outer surface comprising yarns having relatively low friction characteristics. The outer ply, within which the first ply is disposed, has an inner surface comprising yarns having relatively low friction characteristics and an outer surface comprising a plurality of substantially untwisted fibers around which a yarn is spirally wound to provide low-friction interface surfaces. Similar to the East sock, the Hursh sock is knit from a single tube and everted so that the inner ply fits within the outer ply, with the plies connected only at the top and at the toe.

Another form of a double layer sock is disclosed in U.S. Pat. No. 4,958,507 to Allaire et al. The method of making the sock begins with knitting a first course that is transferred to a transfer plate (also known as a dial plate) to remain in standby while the balance of the double layer sock body is knitted. The retained first course is then transferred from the dial plate at the end of the knitting process to form a connection between the inner layer and the outer layer at the toe. When the inner and outer layers are connected at the toe, additional courses are knit to form a single tubular terminal layer that extends beyond the two sock layers that is used to close the toe on a seaming machine. Thus, there is no seam at the opening of the leg, but only the fold.

Another double layer sock construction is disclosed in U.S. Pat. No. 6,158,254 to Richard. The inner layer is knit in a first tubular segment of normal stitch density and a second tubular segment of low knit density and then the balance of the sock body is knit with normal stitch density to complete the inner layer of the sock. The knitting continues with an outer layer of the sock joined to the inner layer along a fold line and having normal stitch density. The inner and outer layers are maintained with their wales aligned. The sock is discharged from the knitting machine and transferred to a toe-closing machine.

Despite the advantages of the above described socks, it has been found desirable to provide a double layer sock having layers of different material and to provide a method for connecting the layers together at spaced locations during the knitting operation.

SUMMARY OF THE INVENTION

The present invention is directed to a sock with a knit liner or to phrase it differently, a layered sock. The sock is knit of double layer construction formed on a circular knitting machine. The sock has a foot portion extending from the toe to the heel pocket and a leg portion extending from the heel pocket to an upper cuff portion. The sock includes a tubular inner layer having a foot portion and a leg portion merging substantially at the ankle of a wearer and a tubular outer layer surrounding the inner layer. The outer layer has a foot portion and a leg portion merging substantially at the ankle of the wearer and aligning with said foot portion and leg portion, respectively, of the inner layer. The inner layer and the outer layer have a cuff portion at the top of the leg portion. The inner and outer layers are connected at spaced locations by tuck stitches during the knitting operation. The sock is then discharged from the knitting machine and transferred to a toe closing machine. In a preferred embodiment of the invention the inner layer and the outer layer may be knit using different yarns.

The present invention also provides a method of making such a double layer sock of unitary tubular construction. Knitting of the outer layer and the inner layer occurs simultaneously.

It is a general object of the present invention to provide a double layer sock, especially one that can be knit from different materials.

Another object of the present invention is to provide a method for knitting a double layer sock.

Other objects, features and advantages of the present invention will become evident from the following detailed description of the invention taken with the accompanying drawings.

BRIEF DESCRIPTION OF THE DRAWINGS

Figure 1:
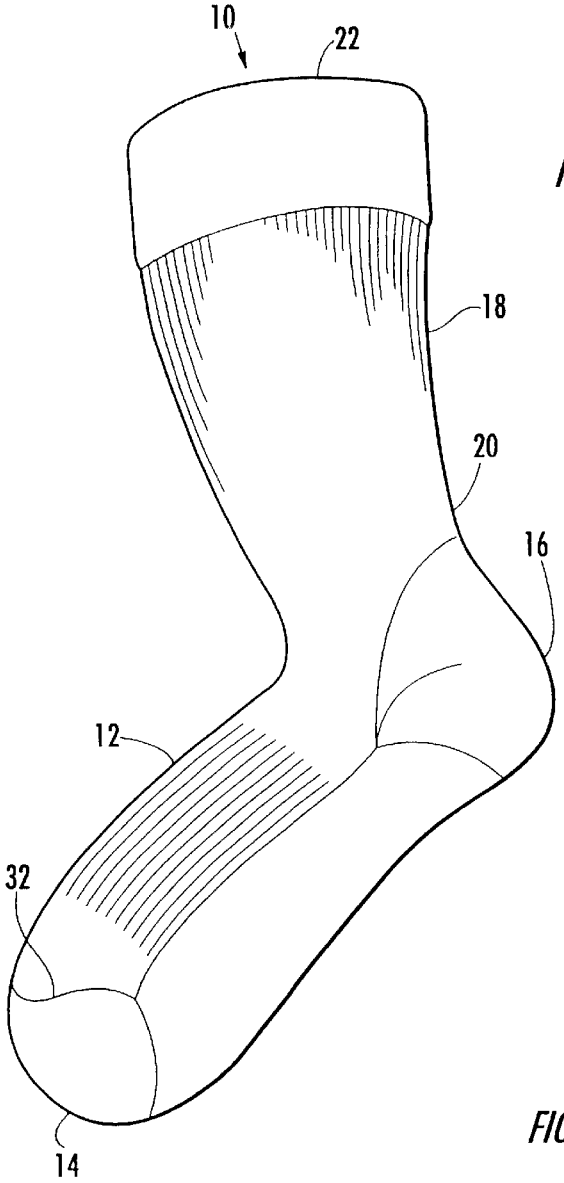
Figure 2:
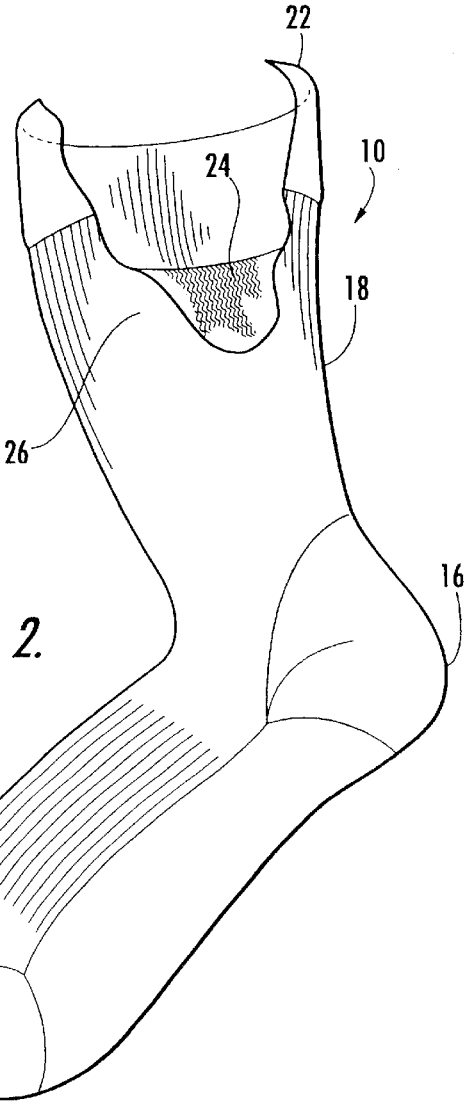
Figure 3:
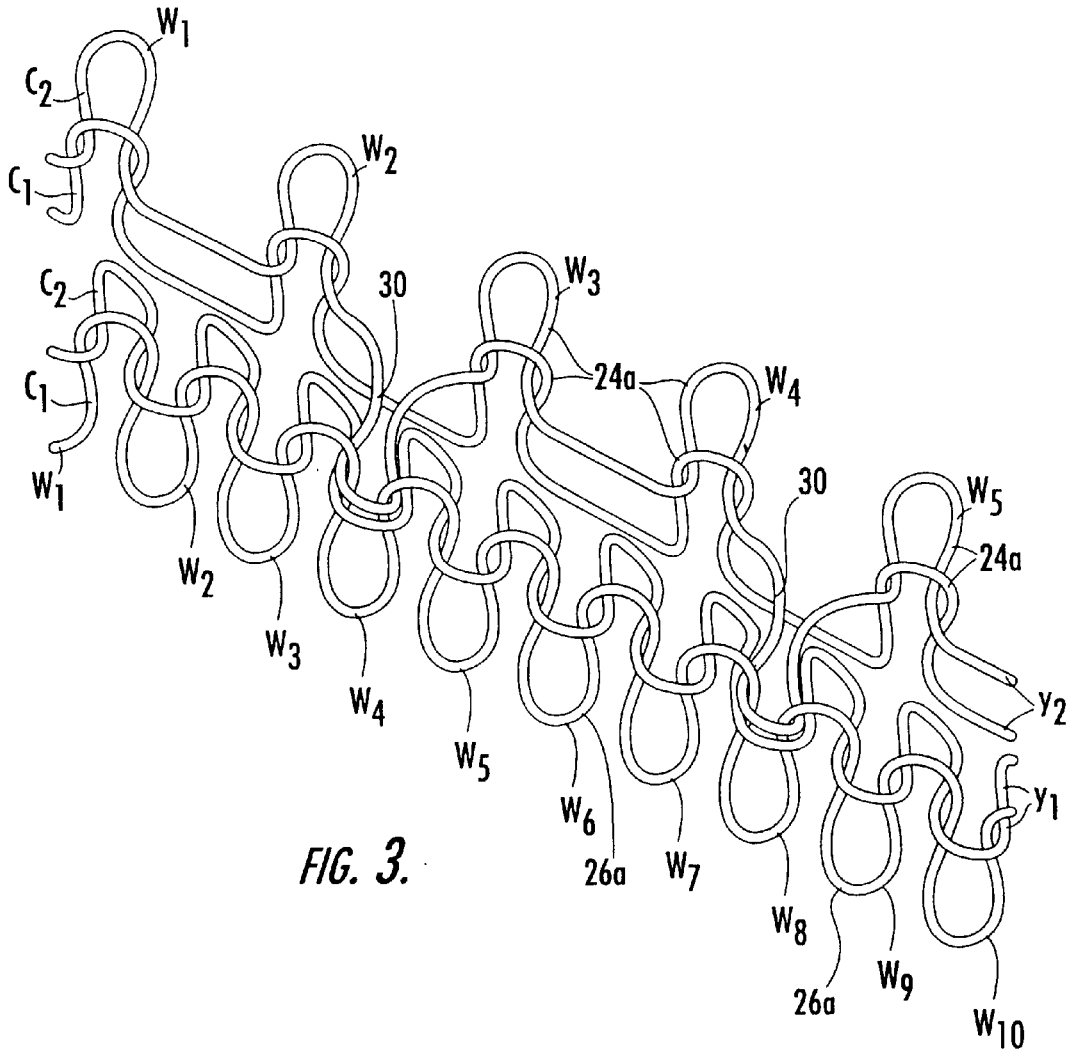

Having thus described the invention in general terms, reference will now be made to the accompanying drawings, which are not necessarily drawn to scale, and wherein:

FIG. 1 is a side elevational view of the double layer sock of this invention;

FIG. 2 is a perspective view of the double layer sock of this invention as it appears having a portion cut away; and FIG. 3 is an enlarged fragmentary perspective view of the knit structure of the sock illustrated in FIGS. 1 and 2.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIG. 1 illustrates a sock according to the present invention and generally denoted by the numeral 10. The sock 10 is knit of a double layer construction, and is characterized by the two layers being connected together at spaced apart locations during the knitting thereof. Turning to the sock in more detail, sock 10 has a foot portion 12 extending from a toe 14 to a heel pocket 16, and a leg portion 18 having a lower end 20 extending from heel pocket 16 of foot portion 12 and a cuff 22 at its upper end defining a top opening.

Sock 10 includes an inner layer 24 and an outer layer 26. Each layer 24 and 26 extends through the foot portion 12 and through at least a portion of leg portion 18. Preferably, the yarns forming the inner layer 24 and the outer layer 26 are knit together as a single layer to form the cuff 22, the heel pocket 16 and toe pocket 14. The inner layer 24 is connected to the outer layer 26, or vice versa, at spaced locations during knitting thereof. Preferably, this connection is provided by tuck stitches 30 which are in selected courses and wales of the inner layer 24 and outer layer 26.

In accordance with the present invention, the sock 10 may be knit on any conventional circular knitting machine having a cylinder and dial capable of knitting socks, two examples of which are a 4 inch diameter 156 needle cylinder circular hosiery knitting machine with a cooperating dial having needles therein and with or without a LIN toe closing device, and a 4 inch diameter 112 needle cylinder circular knitting machine with a cooperating dial and a LIN toe device. Such knitting machines are conventionally provided with two yarn feeds that supply yarns to the cylinder and dial needles at spaced apart locations around the circular knitting machine.

The outer layer 26 of the sock 10 is preferably knit on the cylinder needles while the inner layer 24 is knit on the dial needles. The main yarn feed of the knitting machine (not shown) feeds a first yarn $Y_1$ to the cylinder needles to form stitch loops 26*a* arranged in courses $c_1$, $c_2$ and wales $w_1$–$w_{10}$ (FIG. 3). For illustration only, the stitch pattern illustrated in FIG. 3 is a plain or jersey stitch patter, but it would be understood that outer layer 26 may be knit in any desired stitch pattern.

The secondary yarn feed of the knitting machine (not shown) feeds a second yarn $Y_2$ to the dial needles to form stitch loops 24*a* arranged in courses $C_1$ and $C_2$ and wales $W_1$–$W_5$. As shown in FIG. 3, the dial needles are used to form stitch loops 24*a* in inner layer 24 as compared to the cylinder needles forming stitch loops 26*a* in outer layer 26.

At spaced locations, such as in alternate courses $c_2$ of the outer layer 26 and $C_2$ of the inner layer 24 and such as in every fourth wale $w_4$ and $w_8$ of the outer layer 26, the inner layer 24 and outer layer 26 are connected together by tuck stitches 30. To form such tuck stitches, the cylinder needles forming such wales in those courses are raised to the tuck position as they approach the secondary yarn feed of the knitting machine so that the yarn $Y_2$ is captured by the cylinder needles and knit into the outer layer 26 along with a stitch loop of the yarn $Y_1$ from the main yarn feed to connect the two layers 24, 26 together. The spacing between the locations of the connecting stitch loops 30 and the type of connections may vary without departing from the present invention.

After the sock blank has knit, the toe is closed, such as by a LIN Toe device or seaming machine, with a toe closure seam 32, shown in FIG. 1.

In a preferred embodiment of the invention, each layer may be different. As will be understood by those skilled in the art, double layer socks can be knit according to the present invention with the use of various types of yarn in various weights. The selection of natural or synthetic yarn, textures, and patterns is dependent on the anticipated use to which the socks may be put. For example, the sole portion of the foot portion 12 may be reinforced or made thicker or the foot portion 12 may have terry loops knit therein.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A double layer sock formed on a circular knitting machine from at least two yarns, comprising:

(a) a tubular inner layer having a foot portion and a leg portion merging substantially at the ankle of a wearer knit of at least one yarn and having wales and courses;

(b) a tubular outer layer surrounding said inner layer knit of at least one other yarn and having wales and courses, said outer layer having a foot portion and a leg portion merging substantially at the ankle of the wearer and aligning with said foot portion and said leg portion, respectively, of said inner layer; and (c) said inner and outer layers being connected together at spaced apart wales and courses by one of said yarns extending between said layers.

2. The sock according to claim 1 wherein said yarn extending between inner layer and said outer layer is knit into both layers.

3. The sock according to claim 2, wherein said yarn extending between said layers is knit predominately in one layer and is knit only for connection purposes in the other layer.

4. The sock according to claim 3, wherein said yarn extending between said layers is knit in said outer layer as tuck stitch loops.

5. The sock according to claim 1 wherein said inner layer and said outer layer are made substantially of yarns having the same characteristics.

6. The sock according to claim 1 wherein said inner layer and said outer layer are made substantially of yarns having different characteristics.

7. The sock according to claim 1 wherein said inner layer and said outer layer are made of natural yarns, synthetic yarns or combinations of natural and synthetic yarns.

8. A method of knitting a double layer sock on a circular knitting machine comprising:

(a) knitting at least one knitting yarn into courses and wales to form an inner layer of the sock, (b) knitting at least one other knitting yarn into courses and wales to form an outer layer of the sock in surrounding relation to said inner layer, and (c) connecting said inner and outer layers together at spaced apart wales and courses by causing one of said knitting yarns to extend between said inner and outer layers.

9. The method according to claim 8 wherein said yarn extending between said layers is knit into both layers.

10. The method according to claim 9 wherein said yarn extending between said layers is knit predominately in one layer and is knit for connection purposes only in the other layer.

11. The method according to claim 10 wherein said yarn extending between said layers is knit into the other layer as tuck stitch loops.

12. The method according to claim 9 wherein said inner layer is knit on dial needles of the circular knitting machine and said outer layer is knit on cylinder needles thereof.

13. The method according to claim 12 wherein said yarn extending between said layers is a yarn from said inner layer extending into said outer layer.

14. The method according to claim 12 wherein said spaced locations are in selected courses and selected wales of said inner and outer layers.

15. The method according to claim 12 wherein said knitting yarns are knit into a single layer in cuff, heel and toe portions of the sock and into inner and outer layers in the remainder of the sock.

* * * * *